US009074384B2

(12) United States Patent
Lin et al.

(10) Patent No.: US 9,074,384 B2
(45) Date of Patent: Jul. 7, 2015

(54) COMBINED SWIMMING POOL LADDER STRUCTURE

(75) Inventors: Hua Hsiang Lin, Xiamen (CN); Matthew J. Whalen, III, Long Beach, CA (US)

(73) Assignee: INTEX RECREATION CORP., Long Beach, CA (US)

( * ) Notice: Subject to any disclaimer, the term of this patent is extended or adjusted under 35 U.S.C. 154(b) by 760 days.

(21) Appl. No.: 13/192,054

(22) Filed: Jul. 27, 2011

(65) Prior Publication Data

US 2013/0025042 A1 Jan. 31, 2013

(51) Int. Cl.
*E04H 4/00* (2006.01)
*E04H 4/14* (2006.01)

(52) U.S. Cl.
CPC ..... *E04H 4/144* (2013.01)

(58) Field of Classification Search
CPC ..... E04H 4/00
USPC ..... 4/488–513; 482/55
See application file for complete search history.

(56) References Cited

U.S. PATENT DOCUMENTS

| | | | | |
|---|---|---|---|---|
| 3,991,851 | A * | 11/1976 | Gannon | 182/86 |
| 4,805,736 | A * | 2/1989 | Byrnes, Jr. | 182/95 |
| 6,755,281 | B2 * | 6/2004 | Saputo et al. | 182/118 |
| 2007/0193833 | A1 * | 8/2007 | Nickelson | 182/206 |

FOREIGN PATENT DOCUMENTS

CN 201190435 Y 2/2009

OTHER PUBLICATIONS

Photograph of ladder from Kayak Pool Corporation, Photo Gallery, 1 page, available at http://www.kayakpools.com/corporate/KP_Hamburg_2.JPG, accessed on Nov. 5, 2010.
Confer Plastics, Inc., The Leader in Ladders Brochure, 6 pages, published Oct. 2010, available at http://www.conferplastics.com/ConferBrochureLadder.pdf, accessed on Nov. 5, 2010.
English Abstract of Chinese Patent No. CN 201190435 (Y).
International Search Report and Written Opinion for PCT/US2012/048486, 10 pages, mailing date Oct. 15, 2012.

* cited by examiner

*Primary Examiner* — Lori Baker
(74) *Attorney, Agent, or Firm* — Faegre Baker Daniels LLP

(57) ABSTRACT

A combination ladder assembly and pool includes a pool having a side wall and a support member positionable along an inner surface of the side wall of the pool. The support member may include at least one aperture. Additionally, the combination ladder assembly and pool further includes a ladder positionable along an outer surface of the side wall of the pool. The ladder may be removably coupled to the support member. The ladder further includes at least one leg having a first end and a second end and a plurality of steps. The plurality of steps may be coupled to the leg of the ladder between the first end and the second end of the leg. The ladder may be moveable between a use position, permitting ingress into the pool, and a storage position. When the ladder is in the use position, the leg of the ladder is supported by the support member. When the ladder is in the storage position, the ladder extends from the aperture of the support member to cantilever from the support member.

22 Claims, 6 Drawing Sheets

COMBINED SWIMMING POOL LADDER STRUCTURE

FIELD OF THE INVENTION

The present invention relates to swimming pool equipment, in particular to a swimming pool ladder.

BACKGROUND AND SUMMARY OF THE INVENTION

An above-ground pool generally requires a ladder to facilitate ingress into the pool and egress from the pool. Pool ladders may be movable from a use position to a storage position. By moving the pool ladder to the storage position, ingress into the pool may be restricted.

According to the present invention, a combination ladder assembly and pool is provided. The combination includes a pool with a side wall; a support member; and a ladder. The support member is positionable adjacent the side wall of the pool. The support member includes at least one aperture. Additionally, the ladder is positionable adjacent an outer surface of the side wall of the pool and is removably coupled to the support member. The ladder includes at least one leg with a first end and a second end and a plurality of steps. The plurality of steps is coupled to the leg between the first end and the second end. The ladder is moveable between a use position, permitting ingress into the pool, and a storage position. When the ladder is in the use position, the leg of the ladder is supported by the support member. When the ladder is in the storage position, the ladder extends from an aperture to cantilever from the support member.

According to another aspect of the present invention, a combination ladder assembly and pool is provided, including a pool and a ladder. The pool has a side wall and may be substantially filled with water. The ladder assembly includes a support member positioned adjacent the side wall of the pool. The ladder assembly further includes a ladder coupled to the support member. The ladder has a first end, a second end, and a plurality of steps supported on the ladder between the first end and the second end. The ladder is moveable from a use position, permitting ingress into the pool, to a non-use position. When the ladder is in the use position, a portion of the ladder is supported by the support member at a first location. When the ladder is in the non-use position, the portion of the ladder is coupled to the support member at a second location that is distinct from the first location.

According to another embodiment of the present invention, a packaged pool and ladder assembly is provided. The packaged pool and ladder assembly includes a container, a pool, and a ladder assembly. The container includes an interior region and the pool is received within the interior region of the container. The ladder assembly also is received within the interior region of the container and is configured to be assembled with the pool. The ladder assembly further includes a support member and a ladder. The ladder is configured to removably couple with the support member. The ladder includes at least one leg and a plurality of steps. The leg of the ladder has a first end and a second end and is configured to support the plurality of steps between the first end and the second end. The ladder is moveable between a use position, permitting ingress into the pool, and a storage position. When the ladder is in the use position, at least one of the first end and the second end of the ladder are configured to be supported by the support member at a coupling location. When the ladder is in the storage position, the ladder is coupled to the support member in a location restricting use of the ladder for ingress into the pool. A bottom step of the plurality of steps of the ladder is spaced apart from the coupling location when the ladder is in the use position by a first distance. The bottom step of the plurality of steps of the ladder is spaced apart from the coupling location by a second distance when in the storage position. The second distance is substantially different from the first distance.

According to another aspect of the present invention, a method of using a ladder assembly with a pool is provided. The method includes the steps of providing a support member adjacent a pool wall and detaching a ladder from the support member. The method of using the ladder assembly further includes the step of moving the ladder from a use position, permitting ingress into the pool, to a non-use position, restricting use of the ladder for ingress into the pool. The ladder is coupled to the support member when the ladder is in the non-use position.

BRIEF DESCRIPTION OF THE DRAWINGS

The above-mentioned and other features of the present disclosure, and the manner of obtaining them, will become more apparent and the disclosure itself will be better understood by reference to the following description taken in conjunction with the accompanying drawings, wherein.

Figure 1:
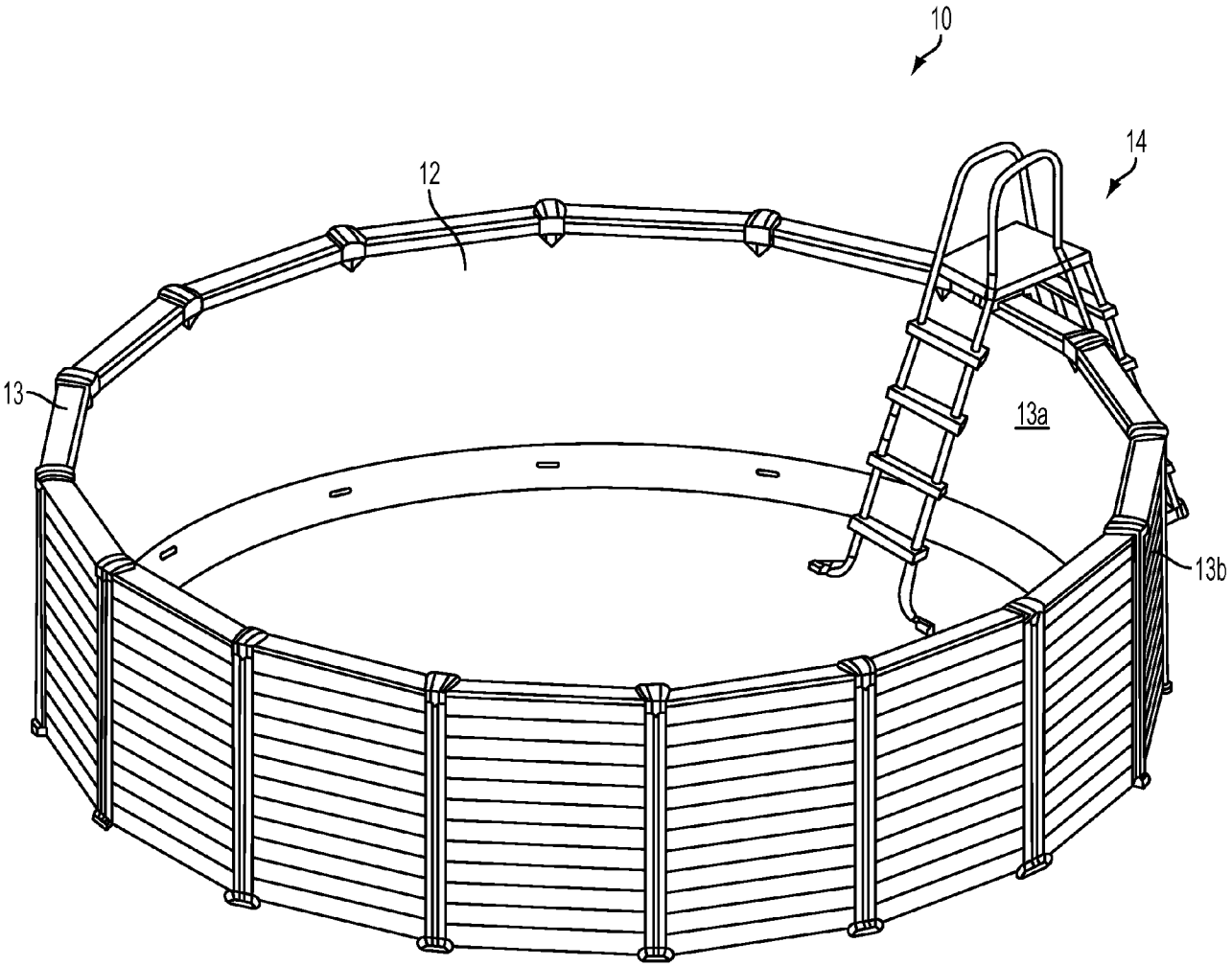
FIG. 1 is a perspective view of an above-ground pool.

Corresponding reference characters indicate corresponding parts throughout the several views. Although the drawings represent embodiments of the present disclosure, the drawings are not necessarily to scale and certain features may be exaggerated in order to better illustrate and explain the present disclosure.

DETAILED DESCRIPTION OF THE PREFERRED EMBODIMENTS

The embodiments disclosed below are not intended to be exhaustive or limit the invention to the precise forms disclosed in the following detailed description. Rather, the embodiments are chosen and described so that others skilled in the art may utilize their teachings.

As shown in FIG. 1, the present disclosure provides an above-ground swimming pool 12 having a side wall 13. Side wall 13 of pool 12 may be inflatable, made of a plastic material, or side wall 13 may include a frame and metal side panels. When pool 12 is constructed from a metal frame, side wall 13 also may include plastic liners to retain the water within the metal frame. Pool 12 may be configured in various shapes and sizes. Illustratively, pool 12 is shown as circular, however, pool 12 may be oval, square, or rectangular shaped.

Typically, pool 12 is substantially filled with water. Illustratively, pool 12 is 10 feet in diameter and 30 inches in height and, as such, pool 12 is able to accommodate more than one person. Additional details regarding above-ground pools may be found in U.S. Pat. No. 6,408,453 to Song, et al., the disclosure of which is expressly incorporated herein.

Figure 3:
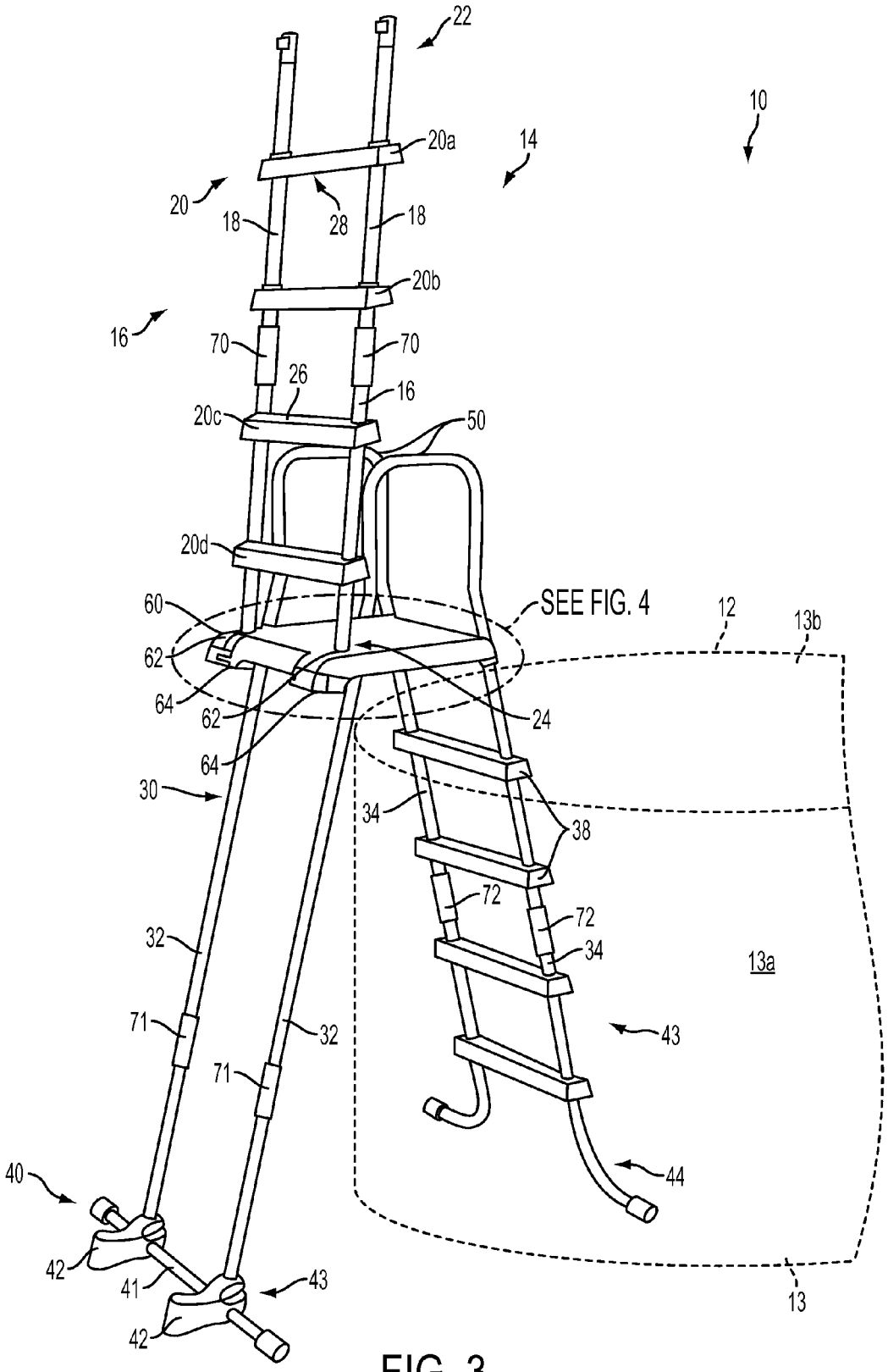
FIG. 3 is a perspective view of an above-ground pool in combination with the ladder assembly of FIG. 2, showing the ladder in a storage position preventing ingress into the pool (shown in phantom) by restricting use of the ladder.

Referring to FIG. 3, a pool and ladder combination 10 is shown. Pool and ladder combination 10 includes pool 12 and ladder assembly 14. Ladder assembly 14 facilitates ingress into pool 12 and egress from pool 12. Illustratively, ladder assembly 14 is positioned along both an inner surface 13*a* and an outer surface 13*b* of side wall 13 of pool 12 so that ladder assembly 14 extends above side wall 13 as shown in FIG. 1. Referring back to FIG. 3, ladder assembly 14 includes a ladder 16 and a support member 30. Ladder 16 removably couples to support member 30 in multiple configurations.

Figure 2:
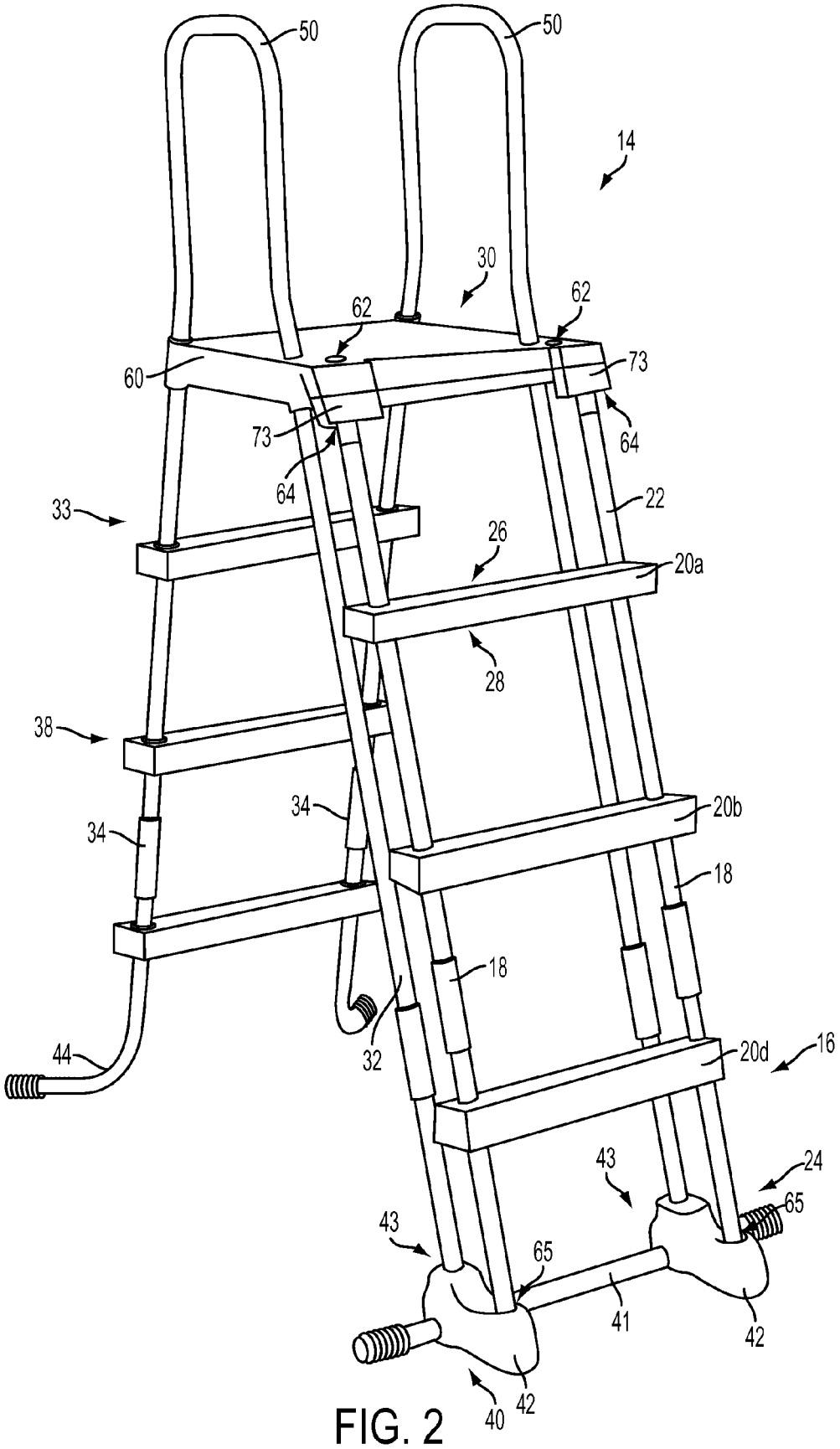
FIG. 2 is a perspective view of a pool ladder assembly, showing a ladder in a use position.

Referring now to FIG. 2, ladder 16 is shown in a use position to provide ingress into pool 12 and egress from pool 12. In the use position, ladder 16 removably couples to support member 30 along outer surface 13*b* of side wall 13 of pool 12 as shown in FIG. 1. Ladder 16 illustratively includes a plurality of legs 18 and a plurality of steps 20, including individual steps 20*a*, 20*b*, 20*d* having a top surface 26 and a bottom surface 28. Fewer or more steps may be provided, such as step 20*c* shown in FIG. 3. When ladder 16 is in the use position, top surface 26 of steps 20*a*, 20*b*, 20*d* face upwardly and bottom surface 28 of steps 20*a*, 20*b*, 20*d* face downwardly. Top surface 26 of steps 20*a*, 20*b*, 20*d* may be rough, or grooved, to provide traction when using ladder 16. Legs 18 of ladder 16 are a circle in cross-section, however, legs 18 may have other cross-sectional configurations (e.g., square, oval, hexagon). In the use position, an upper end 22 and a lower end 24 of ladder 16 are coupled to support member 30, with lower end 24 of ladder 16 being proximate the ground.

Referring back to FIG. 3, ladder 16 is shown in a non-use, or storage, position. Upper end 22 or lower end 24 of ladder 16 is removably coupled to support member 30, such that ladder 16 is in a cantilevered position extending upwardly from support member 30. Illustratively, lower end 24 is coupled to support member 30 and, as such, when ladder 16 is in the non-use position, ingress into pool 12 is restricted.

As is shown in FIGS. 2 and 3, support member 30 illustratively is an A-frame construction and ladder 16 is removably coupled thereto. Support member 30 includes a plurality of legs 32 and a plurality of legs 34 extending along outer surface 13*b* and inner surface 13*a* of side wall 13, respectively. While support member 30 is shown having four legs, alternative embodiments of support member 30 may include more or less than four legs. Legs 32 and legs 34 are shown as circles in cross-section, but other cross-sectional configurations (e.g., squares, ovals, hexagons) may be provided. Each of legs 34 has a lower end 44 that curves, or bends, outwardly and away from the opposing lower end 44. Conversely, a lower end 43 of each of legs 32 has a substantially straight configuration and extends substantially perpendicular to the ground. Additionally, legs 34 support a plurality of steps 38 to define a ladder 33 extending along inner surface 13*a* of side wall 13.

Support member 30 further includes a platform 60 and a plurality of handles 50 extending above platform 60 to facilitate ingress into pool 12 and egress from pool 12. Platform 60 is shown as a flat surface positioned above side wall 13 of pool 12 and is capable of supporting the weight of a person standing on platform 60 for ingress into pool 12 and egress from pool 12. Platform 60 is coupled to legs 32 and legs 34 of support member 30 and extends outwardly beyond legs 32 and away from side wall 13 of pool 12. Platform 60 also may have a rough, or grooved, surface to provide traction to a person standing thereon.

Figure 4:
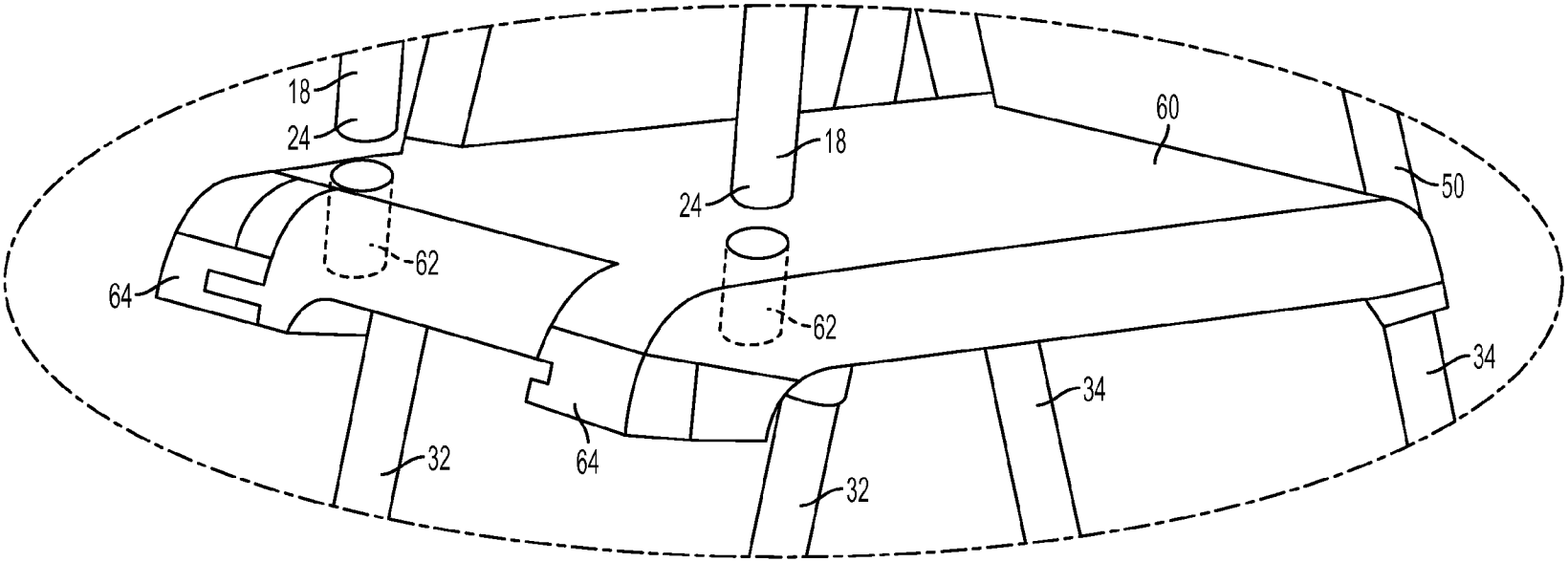
FIG. 4 is a perspective view of the ladder assembly before the ladder is secured in the storage position.

Referring to FIGS. 2 and 4, in the use position, ladder 16 removably couples to support member 30 at a coupling location to permit ingress into pool 12. The coupling location is defined by a plurality of apertures 64 located along a front surface of platform 60 of support member 30. Apertures 64 are shaped to receive upper end 22 of ladder 16; specifically, legs 18 may be received within apertures 64 when ladder 16 is in the use position.

Referring now to FIGS. 3 and 4, ladder 16 is movable between the use position to the storage position in order to restrict ingress into pool 12. Illustratively, platform 60 includes a plurality of apertures 62 that are shaped substantially similar to legs 18 of ladder 16. Apertures 62 are shaped to receive upper end 22 and/or lower end 24 of ladder 16 and are spaced apart from apertures 64. When ladder 16 is moved to the storage, or non-use, position, legs 18 are positioned within apertures 62 and, as such, ladder 16 is cantilevered from platform 60 of support member 30. Illustratively, lower end 24 of ladder 16 is positioned within apertures 62 of platform 60 when ladder 16 is in the storage position and upper end 22 of ladder 16 extends, unsupported, above support member 30. In this way, top surface 26 of steps 20*a*, 20*b*, 20*c*, 20*d* of ladder 16 face upwardly and bottom surface 28 of steps 20*a*, 20*b*, 20*c*, 20*d* face downwardly when ladder 16 is in the storage position.

Although support member is shown as in an A-frame configuration, other configurations may also be provided. For example, platform 60 with apertures 62 may be a deck around all or a portion of pool 12 with or without inner ladder 33 being provided or coupled to the deck.

Still referring to FIG. 3, support member 30 further includes a base member 40 supported by the ground and proximate outer surface 13*b* of side wall 13 of pool 12. Base member 40 is substantially perpendicular to legs 32 and extends between a plurality of feet 42. Each of feet 42 is shaped substantially similar to legs 18 of ladder 16. Therefore, when ladder 16 is in the use position, upper end 22 of ladder 16 is removably coupled to apertures 64 at the coupling location and lower end 24 of ladder 16 is removably coupled to base member 40. In other words, when ladder 16 is in the use position, both upper end 22 and lower end 24 of ladder 16 are supported by support member 30.

Figure 6:
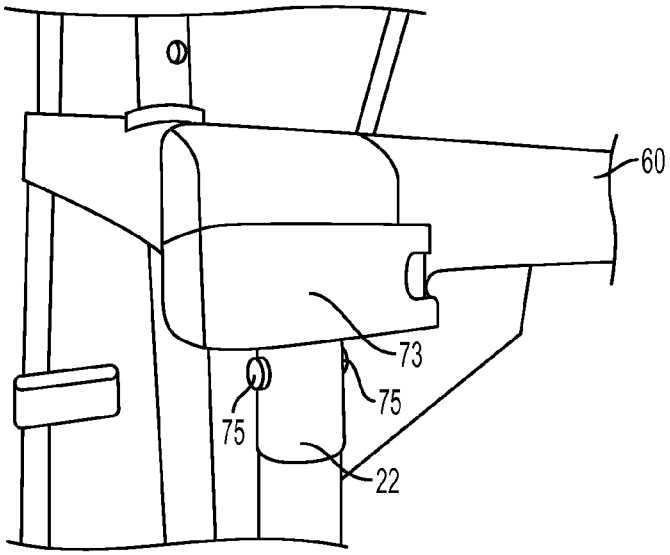
FIG. 6 is a perspective view showing an upper portion of the ladder secured in the use position.
Figure 7:
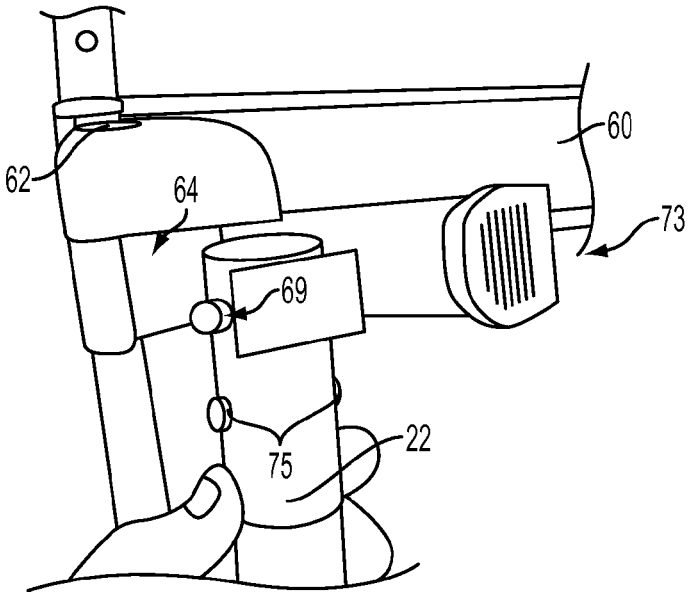
FIG. 7 is a perspective view showing the upper portion of the ladder moved from the use position.

As shown in FIGS. 6 and 7, apertures 64 are defined by recesses formed in platform 60 that are sized to receive upper ends 22 of ladder 16. Upper ends 22 can be removed and reinserted into recesses 64 during movement of ladder 16 between the use and storage positions.

Figure 8:
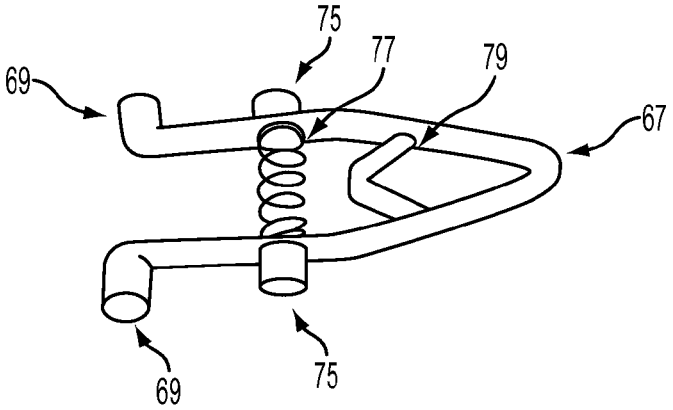
FIG. 8 is a view of a clip normally positioned in upper ends of the ladder.

V-shaped clips 67 (shown in FIG. 8) are positioned in upper ends 22 of ladder 16 to secure upper ends 22 in recesses 64 when ladder 16 is in the use position. Clips 67 include a pair of outwardly extending projections 69 that are received in slots or holes (not shown) defined within recesses 64. After upper ends 22 of ladder 16 are positioned in recesses 64 and projections 69 are received in the slots, hinged latches 73 are swung shut to cover upper ends 22. The preferred slots have a width slightly larger than a diameter of projections 69 and a height to allow projections 69 to ride slightly up and down.

To move ladder 16 to the storage position, latches 73 are swung to the open position shown in FIG. 7. Next, projections 69 are retracted from the holes by pressing on buttons 75 on clip 67. Upon release of buttons 75, springs 77, 79 extend projections 69 back out.

To move ladder to the use position, latches 73 are swung to the open position if they were previously closed. Next, lower ends 24 of ladder are positioned in sockets 65 of feet 42. Next, projections 69 are retracted and upper ends 22 are positioned in recesses 64. Projections 69 may either be retracted by pressing buttons 75 or by the walls of recesses 64. Once in position, projections 69 extend back into the holes in the walls defining recesses 64. Last, latches 73 are swung to the closed position as shown in FIG. 6.

Figure 5:
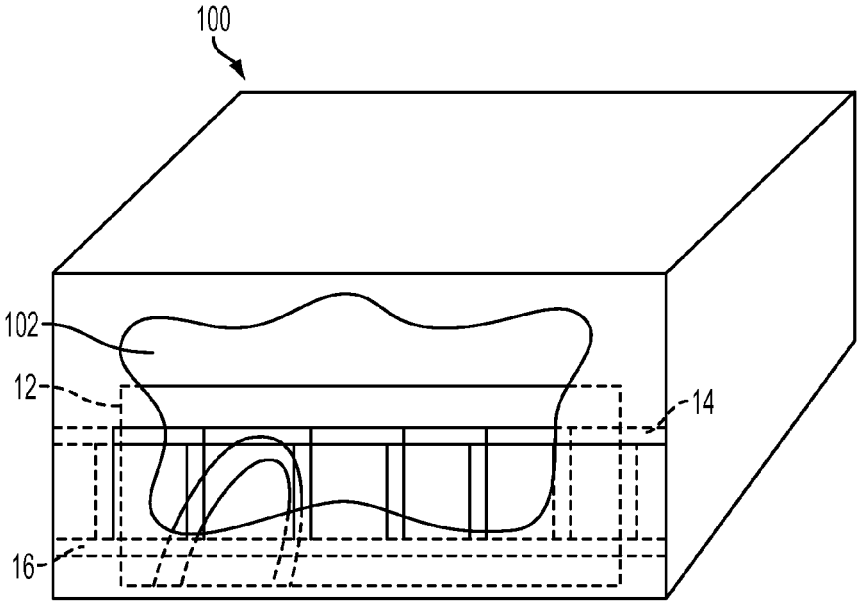
FIG. 5 is a perspective view of a container having the pool and ladder combination of FIG. 3 within an enclosed region of the container.

Referring now to FIGS. 3 and 5, legs 32 and legs 34 of support member 30 may be disassembled for easy storage or packaging. Illustratively, legs 32 and legs 34 of support member 30 include portions 71 and portions 72, respectively. Portions 71 are used to form legs 32 and portions 72 are used to form legs 34, as pool and ladder combination 10 is being assembled. Similarly, legs 18 of ladder 16 include portions 70 to assemble legs 18. Portions 70, 71, and 72 allow ladder assembly 14 to be disassembled into smaller components to facilitate packaging within a container, or package, 100. Similarly, pool 12 may be deflated and folded into a compact assembly for packaging within container 100. Container 100 includes an interior region 102, in which deflated pool 12 and disassembled ladder assembly 14 are placed.

In use, when ingress into pool 12 is desired, ladder 16 is removably coupled to support member 30 and base member 40 along outer surface 13*b* of side wall 13. Upper end 22 of ladder 16 is coupled to support member 30 at the coupling locations 64 and lower end 24 of ladder 16 is coupled to base member 40. As such, bottom step 20*d* of ladder 16 is spaced farthest from the coupling location, relative to steps 20*a*, 20*b*, 20*c*, when ladder 16 is in the use position.

However, when ladder 16 is moved to the storage, or non-use, position to prevent ingress into pool 12, a force is applied to ladder 16 to remove, or detach, ladder 16 from base member 40 and apertures 64. As such, when ladder 16 is moved between the use position and the storage position, ladder 16 is no longer coupled to support member 30 and temporarily is an individual structure. To position ladder 16 in the storage position, either upper end 22 or lower end 24 of ladder 16 is positioned within apertures 62 of platform 60. Illustratively, lower end 24 is positioned within apertures 62 and supported by platform 60 and upper end 22 extends in a cantilevered positioned. As such, when ladder 16 is in the non-use position, bottom step 20*d* of ladder 16 is positioned nearest to the coupling location (i.e., apertures 64), relative to steps 20*a*, 20*b*, 20*c*. In this way, when ladder 16 is moved between the use position and the non-use position, ladder 16 moves to a position at least half the height of the water in pool 12.

While aspects of this disclosure have been described as having an exemplary design, the illustrative embodiment of the present disclosure may be further modified within the spirit and scope of this disclosure. This application is therefore intended to cover any variations, uses, or adaptations of the preferred embodiment using its general principals. Further, this application is intended to cover such departures from the present disclosure as come within known or customary practices in the art to which this invention pertains.

What is claimed is:

1. A combination ladder assembly and pool including:

a pool having a side wall;

a support member positionable adjacent the side wall of the pool and having at least one aperture opening upwardly; and a ladder positionable adjacent an outer surface of the side wall of the pool and being removably coupled to the support member, the ladder including:

at least one leg having a first end and a second end; and a plurality of steps coupled to the at least one leg between the first end and the second end, the ladder being movable between a use position extending downwardly relative to the support member and permitting ingress into the pool and a storage position, when in the use position, the leg being supported by the support member, and when in the storage position, the ladder extending upwardly from the aperture relative to the support member to cantilever from the support member, the aperture being sized to receive the at least one leg of the ladder.

2. The combination ladder assembly and pool of claim 1, wherein the aperture is a first aperture and the support member includes a second aperture spaced apart from the first aperture, one of the first end and the second end of the leg of the ladder is removably received within the second aperture when the ladder is in the use position.

3. The combination ladder assembly and pool of claim 1, wherein the support member includes at least a first leg and a second leg, a lower end of one of the first leg and the second leg of the support member is curved, and a lower end of the other of the first leg and the second leg of the support member is substantially straight.

4. The combination ladder assembly and pool of claim 1, wherein each step of the plurality of steps of the ladder includes a top surface and a bottom surface, the top surface of each step faces upwardly when the ladder is in the use position and the storage position.

5. A combination ladder assembly and pool including:

a pool having a side wall and being substantially filled with water; and a ladder assembly including:

a support member positioned adjacent to the side wall of the pool and having a first aperture and a second aperture; and a ladder coupled to the support member, the ladder having a first end, a second end, and a plurality of steps supported on the ladder between the first end and the second end, the ladder being movable from a use position permitting ingress into the pool to a non-use position, when in the use position, the first end of the ladder being positioned above the second end and received within the first aperture of the support member, and when in the non-use position, the second end of the ladder being received within the second aperture of the support member, the first aperture being spaced apart from the second aperture.

6. The combination ladder assembly and pool of claim 5, wherein at least one of the first end and the second end of the ladder moves to a position at least half of the height of the water in the pool when the ladder moves from the use position to the non-use position.

7. The combination ladder assembly and pool of claim 6, wherein the support member includes an aperture to receive the ladder at the second location, one of the first end and the second end of the ladder is removably received within the aperture when the ladder is in the non-use position.

8. The combination ladder assembly and pool of claim 6, wherein the support member includes an aperture to receive the ladder in the first location, one of the first end and the second end of the ladder is removably received within the aperture when the ladder is in the use position.

9. The combination ladder assembly and pool of claim 8, further including at least one base member coupled to the support member and spaced apart from the aperture, such that when the ladder is in the use position the ladder is removably coupled to the base member and the base member is proximate a bottom step of the plurality of steps of the ladder, and the aperture is proximate a top step of the plurality of steps of the ladder.

10. The combination ladder assembly and pool of claim 5, wherein each step of the plurality of steps of the ladder includes a top surface and a bottom surface, the top surface of each step faces upwardly when the ladder is in the use position and the non-use position.

11. The combination ladder assembly and pool of claim 5, wherein the support member includes at least a first leg and a second leg, a lower end of one of the first leg and the second leg of the support member is curved, and a lower end of the other of the first leg and the second leg of the support member is substantially straight.

12. A pool ladder assembly including:

a support member; and a ladder configured to removably couple with the support member, the ladder including at least one leg and a plurality of steps, the at least one leg having a first end and a second end and being configured to support the plurality of steps between the first end and the second end of the leg of the ladder, the ladder being moveable between a use position permitting ingress into the pool and a storage position, when in the use position at least one of the first end and the second end of the leg of the ladder are configured to be supported by the support member at a coupling location, and when in the storage position the ladder is coupled to the support member in a location restricting use of the ladder for ingress into the pool, a bottom step of the plurality of steps is spaced apart from the coupling location when in the use position by a first distance, and the bottom step of the plurality of steps is spaced apart from the coupling location when in the storage position by the second distance that is substantially different from the first distance.

13. The packaged pool and ladder assembly of claim 12, wherein the support member includes an aperture to receive the ladder, the aperture is spaced apart from the coupling location, one of the first end and the second end of the leg of the ladder is removably receivable within the aperture when the ladder is in the storage position.

14. The packaged pool and ladder assembly of claim 13, wherein the ladder is extendable upwardly from the aperture of the support member to cantilever from the support member when in the storage position.

15. The packaged pool and ladder assembly of claim 12, wherein the support member includes an aperture to receive the ladder at the coupling location, one of the first end and the second end of the leg of the ladder is removably receivable within the aperture when the ladder is in the use position.

16. The packaged pool and ladder assembly of claim 12, wherein the bottom step of the plurality of steps of the ladder includes an upper surface and a lower surface, the upper surface of the bottom step is positionable to face upwardly when the ladder is in the use position and the storage position.

17. The packaged pool and ladder assembly of claim 12, wherein the support member includes at least a first leg and a second leg, a lower end of one of the first leg and the second leg of the support member is curved, and a lower end of the other of the first leg and the second leg of the support member is substantially straight.

18. A method of using a ladder assembly with a pool including the steps of:

providing a support member adjacent a pool wall;

detaching a portion of a ladder from a first location of the support member;

moving the ladder from a use position permitting ingress into the pool to a non-use position restricting use of the ladder for ingress into the pool; and coupling the portion of the ladder, when in the non-use position, to a second location of the support member that is distinct from the first location from which the ladder was detached in the detaching step.

19. The method of claim 18, wherein the moving step includes receiving the ladder within a first aperture to place the ladder in the non-use position.

20. The method of claim 19, wherein the ladder is positioned within a second aperture of the support member when the ladder is in the use position, the second aperture is at a location distinct from the location of the first aperture of the support member.

21. The method of claim 19, wherein the moving step includes positioning the ladder as a cantilever when the ladder is in the non-use position.

22. The method of claim 21, wherein the ladder includes a first end and a second end, when the ladder is in the non-use position, one of the first end and the second end of the ladder is positioned in the first aperture and the other of the first end and the second end is extending upwardly from the support member.

* * * * *